United States Patent [19]

Koga et al.

[11] Patent Number: 5,009,172

[45] Date of Patent: Apr. 23, 1991

[54] METHOD FOR AND APPARATUS OF THERMAL TREATMENT OF HUMAN WASTE

[75] Inventors: Shigeyuki Koga; Shigeki Sugiue, both of Takamatsu, Japan

[73] Assignee: Kabushiki Kaisha Toyoseiakusho, Japan

[21] Appl. No.: 384,345

[22] Filed: Jul. 25, 1989

[30] Foreign Application Priority Data

Jul. 29, 1988 [JP] Japan ..... 63-191532

[51] Int. Cl.[5] ..... F23G 5/00

[52] U.S. Cl. ..... 110/242; 110/238; 110/246

[58] Field of Search ..... 110/238, 242, 224, 246

[56] References Cited

U.S. PATENT DOCUMENTS

| | | | |
|---|---|---|---|
| 3,961,587 | 6/1976 | Ozawa | 110/238 |
| 4,084,521 | 4/1978 | Herbold et al. | 110/242 |
| 4,759,300 | 7/1988 | Hansen et al. | 110/238 |
| 4,794,872 | 1/1989 | Henery | 110/238 |

*Primary Examiner*—Henry C. Yuen

[57] ABSTRACT

A method for thermal treatment of human waste has the steps of feeding a predetermined small quantity of human waste into an indirectly heated flash chamber, instantaneously evaporating the human waste with a large capacity of heat in the flash chamber, and decomposing the human waste into a small gaseous water vapor and a residue of human waste.

4 Claims, 1 Drawing Sheet

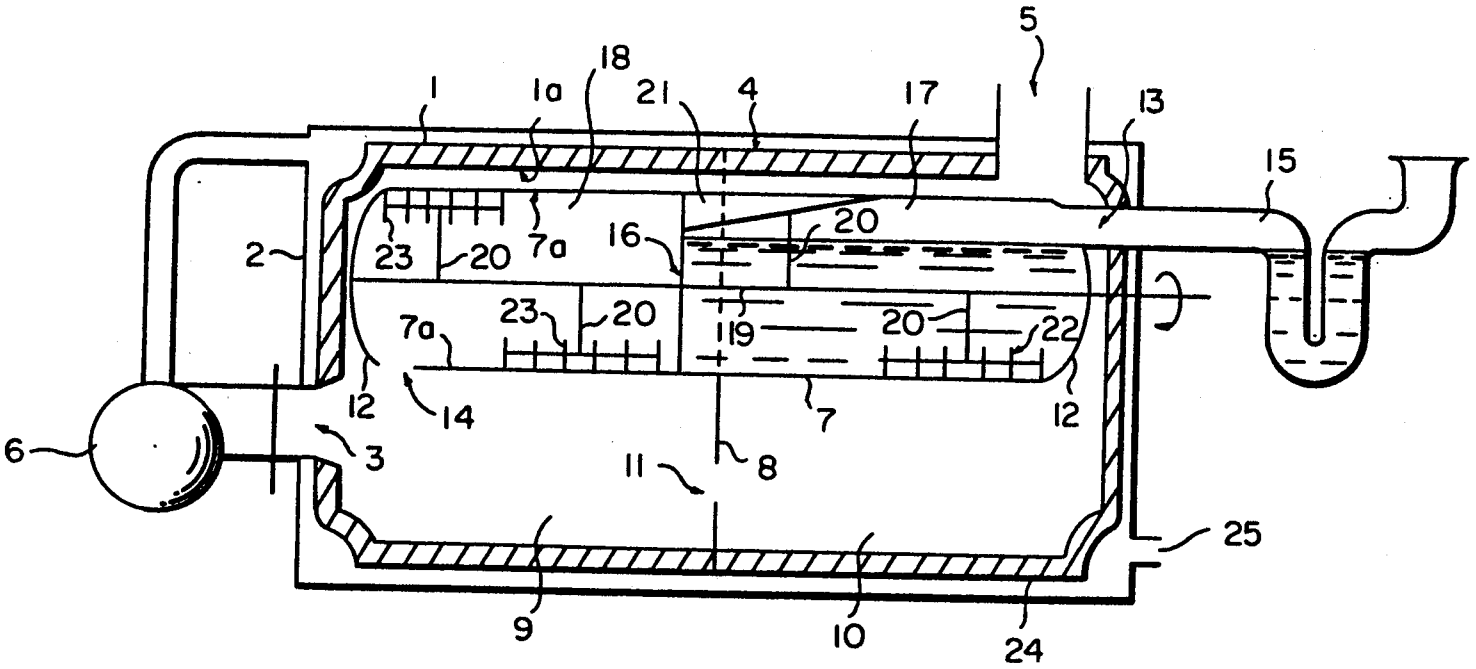
FIG

METHOD FOR AND APPARATUS OF THERMAL TREATMENT OF HUMAN WASTE

BACKGROUND OF THE INVENTION

1. Field of the Invention

This invention relates to a method for and an apparatus of thermal treatment of human waste, and more particularly to a method for and an apparatus of thermal treatment of human waste which is compact and efficient and which can be used for vehicle toilets, movable toilets, etc.

2. Description of the Prior Art

Heretofore, there have been known a water treatment method and a thermal treatment method, as an ordinary method for treating human waste, which uses a heating power. The thermal treatment, when compared with the water treatment, has such advantages as that only a small quantity of ash is produced and no exhaust water is produced and thus sanitary. Therefore, many self-governing communities adopted this method. With this thermal treatment method, the self-governing communities can easily get an amicable consent from local inhabitants for establishing such human waste treating facilities.

However, the conventional thermal treatment method of human waste has such an disadvantage as that a large quantity of fuel is consumed. Therefore, some enterprises, that employed the conventional thermal treatment method, were obliged to cease operation for a while because of an economical reason. In order to overcome these inconveniences, many attempts have been made for improving the thermal efficiency of such system in various fields. As one reason for lowering the thermal efficiency in the conventional method, it has been pointed out that human waste contain some elements for producing an offensive smell gas other than water, besides its structural problem that thermal losses caused by heat dissipation are not sufficiently utilized. In other words, there are two reasons for the conventional thermal treatment apparatus of human waste consuming a large quantity of fuel. One reason is that a moisture contained in the human waste is required to be evaporated, and the other reason is that an evaporated vapor containing elements for an offensive smell is required to be combusted again in order to remove the offensive smell. The ratio of the heat consumption by the above two reasons is found to be about 20% of an intaken heat through a trial calculation.

The quantity of heat consumption in an average thermal treatment apparatus will be shown hereunder.

The quantity of heat for incinerating 1 kg of human waste is as follows.

In the case of a heavy oil: It requires 3005 kcal and 0.307 kg is consumed during combustion for a period of five minutes.

In the case of an electric power: It requires 2652 kcal and 3.7 kw is consumed during combustion for a period 20 minutes.

Let us hereby review a temperature distribution and a heat balance in a rotary kiln system as an ordinary method for treating human waste. Given that an average specific heat at constant pressure of a mixed gas including an exhaust gas and a water vapor generated by means of combustion of a heavy oil at a temperature of 500° C.~800° C. is 0.274, the quantity of exhaust gas generated by means of combustion of a heavy oil is 14 $Nm^3/kg$, the heating value of a heavy oil is 9800 cal per unit weight, and the thermal efficiency is 36.4%, as the heat intaken by means of an evaporating burner is 3005 $kcal/H_2O.kg$, the quantity of a thermal gas of the heavy oil becomes as follows.

$$(3005 \div 9800) \times 14 = 4.3\ Nm^3/H_2O.kg$$

Given that the latent heat is 539, the temperature, the quantity of heat and the capacity of the mixed gas within the rotary kiln become as follows.

Capacity: $1.244 + 4.3 = 5.54\ Nm^3/kg$

Quantity of heat: $(3005 \times 0.364) - 539 = 555$ kcal/5.6Nm3

Temperature: $555 \div (5.5 \times 0.274) = 368°$ C.

Also, the quantity of heat for raising temperature and the capacity of gas which are required for removing the offensive smell is as follows.

Since $5.5 \times (800 - 368) \times 0.274 = 651$ Kcal/5.5$Nm^3$

Quantity of heavy oil: $651 \div 9800 = 0.066$ kg

Quantity of heavy oil gas: $0.066 \times 14 = 0.924\ Nm^3$

From the foregoing, given that the thermal efficiency is 36.4%, it requires the following quantity of heat in order to incinerating 1 kg of human waste.

$$(619 + 651) \div 0.364 = 3489\ kcal$$

In this way, a gas, which is generated when human waste are evaporated by means of direct heating, is a sum of a combustion gas and an evaporation gas. Therefore, as the capacity of an offensive smell gas, the smell of which is required to be removed by means of oxidation, is increased, the quantity of heat consumed for increasing the temperature of the whole offensive smell gas is increased and thus, an economic burden is increased. In addition, there are the following problems.

1. As it is difficult to form a high combustion temperature zone of 800° C., a non-oxidized gas is flowed out.

2. It is unavoidable to enlarge facilities in order to cope with the increased capacity of the offensive smell gas.

3. A large power is required in order to circulate the offensive smell gas including a combustion gas and an evaporation gas within the apparatus until the gas is discharged into atmosphere.

4. As it is difficult to completely seal the rotating portions of the seal type apparatus because of durability or structure, a leakage of gas is easy to occur.

SUMMARY OF THE INVENTION

A general object of the present invention is to provide a method for and an apparatus of a thermal treatment of human waste, in which the quantity of heat dissipated and lost is effectively utilized and the human waste can be effectively removed an offensive smell thereof and incinerated with a small consumption of fuel.

In order to achieve this object, a method for thermal treatment of human waste according to the present invention comprises the steps of feeding a predetermined small quantity of human waste into an indirectly heated flash chamber; instantaneously evaporating said human waste with a large capacity of heat in said flash chamber; and decomposing said human waste into a smell gaseous water vapor and a residue of human waste.

Another method for thermal treatment of human waste comprises, immediately after the step of decomposing human waste into a smell gaseous water vapor and a residue of human waste, the step of further heating said smell gaseous water vapor to a high temperature so as to remove the smell from said human waste by means of oxidation.

Still another method for thermal treatment of human waste comprises, prior to the step of decomposing human waste into a smell gaseous water vapor and a residue of human waste, the step of preheating the human waste.

An apparatus of thermal treatment of human waste according to another aspect of the present invention comprises a heat intaking port; a discharging port; a flash chamber means adapted to instantaneously converting almost all of a small quantity of human waste fed therein into a smell gaseous water vapor; and a burner adapted to remove the smell from said smell gaseous water vapor, which is fed thereto from said flash chamber means by means of oxidation and to heat said flash chamber means.

Another apparatus of thermal treatment of human waste comprises an outer barrel; and an inner barrel including a reservoir chamber and a flash chamber and contained in said outer barrel; said outer barrel being defined into chamber means for removing smell from the human waste by means of oxidation and a discharge gas chamber having a discharging port by a partition wall, said smell removing means containing therein said flash chamber and having a heat intaking port for intaking heat from a burner, partitioning position of said discharge gas chamber being in said reservoir chamber, said partition wall being provided with a through hole for intercommunicating said smell removing chamber and said discharge gas chamber.

Still another apparatus of thermal treatment of human waste comprises a jacket disposed on the periphery of an outer barrel and adapted to feed air to a burner.

These and other objects, features and advantages of the present invention will be well appreciated upon reading of the following description of the invention when taken in conjunction with the attached drawings with understanding that some modifications, variations and changes of the same could be made by the skilled person in the art to which the invention pertains without departing from the spirit of the invention or the scope of claims appended thereto.

BRIEF DESCRIPTION OF THE ATTACHED DRAWINGS

FIG. 1 is a schematic view showing an apparatus of thermal treatment of human waste according to the present invention.

DESCRIPTION OF THE PREFERRED EMBODIMENT

One preferred embodiment of the present invention will be described hereunder with reference to the accompanying drawings.

FIG. 1 shows one embodiment of an apparatus of thermal treatment of human waste according to the present invention.

An outer barrel 1 shown in FIG. 1 is made of an excellent heat resisting and heat insulating material and is laid horizontally. An end plate 2 is formed at its lower part with a heat intaking port 3. A cylindrical wall 4 is formed on one end of its upper part opposite to the heat intaking port 3 with a discharging port 5. The heat intake portion 3 is provided with a burner 6 with its main body disposed outside the outer barrel 1. The outer barrel 1 contains therein an inner barrel 7 which is laid horizontally. The inner barrel 7 occupies a generally half portion of an upper part of the interior of the outer barrel 1 and is spaced part from an inner peripheral surface 1*a*.

Likewise, the interior of the outer barrel 1 is partitioned into a chamber 9 for removing smell by means of oxidation and a chamber 10 for discharging gas by a partition wall 8 covering the periphery of the inner barrel 7 and extending perpendicular to the longitutinal axis. The partition wall 8 is formed at a lower part of the inner barrel 7 with a through hole 11 for intercommunicating the smell removing chamber 9 and the discharge gas chamber 10.

The inner barrel 7 is provided at an upper part of the end plate 2 with a port 13 for intaking human waste. The barrel 7 also is provided on one end portion of a bottom surface of an inner wall surface 7*a* opposite the human waste intaking port 13 with an outlet port 14. This outlet port 14 is disposed proximate to the heat intaking port 3. The human waste intaking port 13 is connected with a vent tube 15 which is formed at its intermediate part with a U-shaped trap and projecting outside the outer barrel 1.

The interior of the inner barrel 7 is partitioned into a reservoir chamber 17 and a flash chamber 18 by an inner barrel partition wall 16 having an excellent heat insulating property. An upper part of the inner barrel partition wall 16 and a ceiling portion of the inner wall surface 7*a* is not contacted with each other and a space is defined therebetween. The inner barrel 7 is provided on its longitudinal axis with a rotational shaft 19 extending through the central position of two end plates 12 and penetrating the inner barrel partition wall 16, one end of the rotational shaft 19 being projected outside the outer barrel 1. The rotational shaft 19 is provided with a drawing water V-shaped groove 21 and a agitating plate 22 which are disposed in the reservoir chamber 17 and with a scraper 23 disposed in the flash chamber 18 and having a feeding function, through an arm 20 respectively. These are rotated along the inner wall surface 7*a* of the inner barrel 7 according to rotation of the rotational shaft 19. The drawing water V-shaped groove 21 is formed into a V-shaped groove type which is inclined as it goes toward the flash chamber 18. The groove 21 draws human waste from the reservoir chamber 17 and is lifted upward until it reaches the ceiling portion of the inner wall surface 7*a*. Upon reaching the ceiling portion, the drawing water V-shaped groove 21 powers the human waste into the flash chamber 18.

The outer barrel 1 is provided on its entire periphery, for example, with a jacket 24 which is communicated with the burner 6. The outer barrel 1 is provided at its bottom part opposite the burner 6 with an air intaking port 25.

Let us hereby calculate the quantity of heat required for carrying out the method for treating human waste according to the present invention.

A human waste is composed of 98% of moisture and 2% of organic material. Therefore, it is correct to consider that the human waste is mostly water. Therefore, it consumes the following quantity of heat;

$$80 \text{ (sensible heat)} + 538 \text{ (latent heat)} = 619 \text{ kcal/kg}$$

under the conditions of a standard atmospheric pressure and a temperature of 20° C. of the original water and becomes a vapor of 100° C.

As this vapor contains an offensive smell gas, it is required that the offensive smell gas is heated up to 700° C.~800° C. and decomposed into a carbonic dioxide ($CO_2$) and a water ($H_2O$) in order to remove the offensive smell.

A total quantity of heat required for heating the vapor upto 800° C. is obtained as follows. Presuming that the average specific heat at constant pressure of vapor is 0.532 and the thermal efficiency is 100% at 500° C.~800° C., the capacity of 1 kg of water is;

$$22.4 \div 18 = 1.244 \text{ Nm}^3$$

the quantity of heat for raising the temperature of vapor is;

$$1.244 + (800 - 100) \times 0.532 = 471 \text{ kcal}$$

thus, the total quantity of heat is;

$$619 + 471 = 1090 \text{ kcal/kg}$$

Next, one example of a method for carrying out the apparatus of thermal treatment of human waste having the above-mentioned constitution will be described.

When a predetermined quantity of human waste is filled in the reservoir chamber 17 via the vent tube 15, the heat intake burner 6 is ignited to raise the temperature of the apparatus. When the reservoir chamber 17, the flash chamber 18 and the smell removing chamber 9 are heated upto the predetermined temperature, the drawing water V-shaped groove 21, the agitating plate 22 and the scraper 23 having the function for feeding are started to rotate along the inner wall surface 7*a* of the reservoir chamber 17 and flash chamber 18. And the drawing water V-shaped groove 21 draws up the preheated (latent) human waste in the reservoir chamber 17 into the flash chamber 18 until it reaches a predetermined quantity (about 3 cc for example).

As the flash chamber 18 is designed as such that the inner wall surface temperature is maintained to 500° C.~580° C. and the inner atmospheric temperature is maintained to 400° C. ~480° C., the moisture contained in the small quantity of human waste drawn up into the flash chamber 18 is instantaneously evaporated, and the evaporated gas is heated upto about 400° C. by atmospheric air in the chamber. That is, when a liquid human waste is directly heated, it turns into a water vapor at 100° C. Therefore, it is impossible to raise the temperature of the human waste more than 100° C. However, by means of feeding a small quantity of human waste into the flash chamber 18 which is heated upto a high temperature, the human waste can be instantaneously turned into an evaporated gas of high temperature. And, the evaporated gas, which is raised in temperature and expanded, fills the flash chamber 18. On the other hand, the space, as one exit of the flash chamber 18, at the upper part of the inner barrel partition wall 16 is continued to the reservoir chamber 17 which is blocked with a trap of the vent tube 15. Therefore, the expanded evaporated gas is jetted into the smell removing chamber 9 through the outlet port 14 by means of its own pressure. The evaporated gas jetted out of the outlet port 14 is oxidized in a temperature zone of about 900° C. within the smell removing chamber 9 which is held at a high temperature by means of heat intaken through the burner 6 in order to remove the smell therefrom. The evaporated gas includes only a separated smell gas component at that time. In addition, as the smell gas component is not passed in its non-oxidized state and is circulated by convection within the smell removing chamber 9 by means of the partition wall 8, a complete removal of smell by means of oxidation can be performed effectively.

Also, a residue of the human waste is separated from a moisture by means of a high temperature evaporation in the flash chamber 18. At this time, the residue of the human waste deposited on the inner wall surface 7*a* of the flash chamber 18 scraped down by the scraper 23 having the function for feeding and fed into the smell removing chamber 9. The residue of the human waste is now in its carbonic state (the reservoir chamber 17 and the flash chamber 18 are now short of oxygen). Therefore, the residue of the human waste is completely burnt into ash.

Thereafter, an exhaust gas having a remaining heat of high temperature which is fed into the exhaust gas chamber 10 from the smell removing chamber 9 is discharged into atmosphere through the discharging port 5 along the outer peripheral surface of the reservoir chamber 17 within the exhaust gas chamber 10.

Air intaken into the jacket 24 through the air intaking port 25 is fed to the burner 6 as a combusting air from the upper surface of the outer periphery of the outer barrel 1.

In this way, the smell gas is heated via the flash chamber 18 from the reservoir chamber 17, then further heated via the smell removing chamber 9 and thereafter discharged into atmosphere. At that time, the smell gas floats in the smell removing atmospheric zone for a period of about 0.4 sec., and the expected removal of smell of the component gas can be achieved.

Also, as a process of treatment which requires the highest temperature is the smell removing zone for the evaporated gas, the position of the burner 6 through which heat is intaken is placed proximate to the outlet port 14 of the flash chamber 18. Therefore, an effective removal of smell can be performed under such obtained most suitable smell removing temperature. And, the remaining heat of the hot gas, which has finished its task for removing the smell, heats the flash chamber 18 located immediately above the smell removing chamber 9. Further, the remaining heat of the exhaust gas fed from the smell removing chamber 9 heats the reservoir chamber 17 located immediately above the exhaust gas chamber 10. As a result, the remaining heat of the exhaust gas is absorbed as a heat for raising the temperature of the apparatus. Therefore, a thermal loss caused by thermal diffusion can be utilized effectively. At the same time, the temperature of the exhaust gas discharged into atmosphere can be lowered.

Furthermore, the temperature of the combusting air of for the burner 6 can be raised by the jacket 24 disposed at the periphery of the outer barrel 1 and the temperature of the interior of the outer barrel 1 is not directly propagated to the outer surface. Therefore, the temperature of the outer surface of the outer barrel 1 can be lowered.

Moreover, when a thermal source for evaporation and a thermal source for removing smell are designed to be taken from one same thermal source and a method for intaking heat is modified to indirect heating means for heating the human waste contained in the inner barrel 7 by means of heating the outer side of the inner barrel 7 with a heavy oil combusting gas instead of directly heating the human waste, a heavy oil combusting gas can be separated from an evaporated gas of the human waste. Therefore, one from which the smell must be removed is only the water vapor. As the capacity of the water vapor is less than the generated gas by means of direct heating, a fuel to be consumed can be reduced.

By the way, the thermal treatment for treating human waste by means of incineration comprises the steps of evaporating about 98% of moisture, raising the temperature of evaporated gas upto a smell removing temperature and combusting the residue of the human waste into ash.

Therefore, the balance of a quantity of heat which is consumed for this thermal treatment will be hereunder.

In order to decompose 1 kg of human waste into a moisture and a residue of human waste under an atmospheric pressure of 0° C., the following quantity of heat is required.

Moisture: $1\times0.98\times(100+539)=626$ kcal

Residue of human waste: $1\times0.02\times400\times0.42=3.36$ kcal

Total: $626+3.36=629.36$ kcal

Whereas the quantity of heat required for raising the temperature of the evaporated gas upto 100° C.~800° C. is as follows;

$$0.98\times(22.4\div18)\times800\times0.532=519 \text{ kcal/kg}$$

Therefore, the quantity of heat required for making 1 kg of the human waste into ash of no smell as follows:

$$629+519=1148 \text{ kcal}$$

Presuming that the heat intaken is 100, let us review the ratio of each outgoing heat. Given that the temperature of the exhaust gas is 430° C., the quantity of heat of the heavy oil is 9800/kcal/kg, the quantity of consumption of the heavy oil is 0.307 kg, and the quantity of the exhaust gas of the combusted heavy oil is 14 $Nm^3$, the quantity of combusted exhaust gas is as follows;

$$14\times0.307=4.3 \text{ Nm}^3\text{/kg}$$

Thus, there can be obtained the following.

Q'ty of heat intaken: $9800\times0.307=3000$ kcal/kg (100)

Q'ty of outgoing heat (q'ty of heat of the human waste treatment): 1148 kcal/kg (38.2)

Q'ty of heat for raising the temperature of apparatus: 847 kcal/kg (28.2)

Q'ty of sensible heat of exhaust gas: $(4.3+1.22)\times430\times0.274=650$ kcal/kg (21.6)

Q'ty of releasing heat on outer surface of apparatus: 355 kcal (12)

The figures in the parentheses show the ratio of outgoing heat vs. intaking heat.

Next, the comparison of the quantities of heat will be shown by means of numerical values obtained by operating an experimental apparatus.

As it requires 6.28 hours for thermal treatment of 96 kg of human waste and 30 kg of heavy oil, the quantity of heat required per unit time is as follows;

Q'ty of intaking heat: $30\div6.28=4.777$ kcal/t

Human waste: $96\div6.28=15.286$ kcal/t

Thus, the quantity of heat per 1 kg of human waste is as follows;

$$(15.286\div4.777)\times9800=3062.5 \text{ kcal}$$

Therefore, as a planned value is 1090 kcal, the efficiency is as follows;

$$(1090\div3062.5)\times100=35.9\%$$

On the contrary, the quantity of intaking heat according to the conventional rotary kilm system is 3489 kcal. Therefore, the comparison of the quantity of intaking heat per 1 kg of human waste is as follows;

$$(3062.5\div3489)\times100=87.77\%$$

Therefore, the quantity of intaking heat according to the method of the present invention is reduced by 12.2%.

Furthermore, the indirect heating system according to the present invention has the following features.

1. As the high temperature zone for combusting a smell gas is formed in position for blowing combusting gas into the apparatus through the heat intaking burner, it also is located in a smell removing zone having an atmospheric temperature of 800° C. or more.

2. The gas evaporated in the flash chamber is raised in temperature and expanded, and is then jetted out through the lower hole. This gas includes only an evaporated gas of the human waste.

3. A certain quantity of heat is consumed separately for each purpose of evaporation, raising temperature and removing smell by means of oxidation. The remaining heat of high temperature in the smell removing process can be utilized for preheating, evaporating and raising temperature.

4. The exhaust gas is pushed out of the system by means of its own expanding pressure (pressure combustion).

5. Although the reservoir chamber and the flash chamber defined in the apparatus contains a rotational portion, the outer periphery of the apparatus is included in the high temperature zone by means of combusting gas for removing the smell. Therefore, there is no fear that a smell gas leaks.

Furthermore, the apparatus of thermal treatment of human waste has the capacity for treating 16.6 cc/m of human waste per minute and is compact. Therefore, this apparatus is most suitable when it is incorporated in moving toilets, temporary rent toilets, etc. which are located at factory cite, etc. On the contrary, the pumps available on market can hardly cope with a slurry-like corrosive aqueous solution. In addition, it is anticipated that the conventional pumps are suffered from such troubles as pipe clogging, valve clogging, fixture, etc. Therefore, the apparatus of thermal treatment of human waste is particularly effective.

A method for and an apparatus of thermal treatment of human waste with the above-mentioned constitution according to the present invention exhibit the following effects.

From one aspect, a method for thermal treatment of human waste according to the present invention comprises the steps of feeding a predetermined small quantity of human waste into an indirectly heated flash chamber; instantaneously evaporating said human waste with a large capacity of heat in said flash chamber; and decomposing said human waste into a smell gaseous water vapor and a residue of human waste. Accordingly, the smell gaseous water vapor can be instantaneously turned into an evaporated gas of high temperature. Furthermore, by means of separating the heavy oil combusting gas and the evaporated gas from each other, it becomes only the evaporated gas from which the smell must be removed. Therefore, the load of the combusting chamber and the quantity of heat for removing the smell can be reduced.

Another method for thermal treatment of human waste comprises, immediately after the step of decomposing human waste into a smell gaseous water vapor and a residue of human waste, the step of further heating said smell gaseous water vapor to a high temperature so as to remove the smell from said human waste by means of oxidation. Accordingly, evaporated gas and the residue of human waste can be combusted completely.

Still another method for thermal treatment of human waste comprises, prior to the step of decomposing human waste into a smell gaseous water vapor and a residue of human waste, the step of preheating the human waste. Accordingly, the smell gaseous water vapor and the residue of the human waste can be decomposed effectively within the flash chamber.

An apparatus of thermal treatment of human waste according to another aspect of the present invention comprises a heat intaking port; a discharging port; a flash chamber means adapted to instantaneously converting almost all of a small quantity of human waste fed therein into a smell gaseous water vapor; and a burner adapted to remove the smell from said smell gaseous water vapor, which is fed thereto from said flash chamber means by means of oxidation and to heat said flash chamber means. Accordingly, the smell gaseous water vapor can be instantaneously turned into an evaporated gas of high temperature. Therefore, the quantity of heat required for combusting the evaporated gas can be reduced.

Another apparatus of thermal treatment of human waste comprises an outer barrel; and an inner barrel including a reservoir chamber and a flash chamber and contained in said outer barrel; said outer barrel being defined into chamber means for removing smell from the human waste by means of oxidation and a discharge gas chamber having a discharging port by a partition wall, said smell removing means containing therein said flash chamber and having a heat intaking port for intaking heat from a burner, partitioning position of said discharge gas chamber being in said reservoir chamber, said partition wall being provided with a through hole for intercommunicating said smell removing chamber and said discharge gas chamber. Accordingly, the quantity of heat of the exhaust gas, from which the smell is removed, can be utilized effectively as a thermal source of indirect heating.

Still another apparatus of thermal treatment of human waste comprises a jacket disposed on the periphery of an outer barrel and adapted to feed air to a burner. Accordingly, the combusting air for the burner can be raised in temperature in order to enhance the combusting efficiency.

What is claimed is:

1. Apparatus for thermal treatment of human waste comprising: an inner barrel partitioned by a wall having a space in its upper part into a reservoir chamber for reserving human waste through an inlet and a flash chamber having an outlet for feeding said human waste from said space by a drawing water barrel to decompose said waste into a gaseous smelling water vapor component and a residue; an outer barrel in which said inner barrel is disposed in an upper part and partitioned by a wall penetrating said inner barrel in an upper part thereof provided with a through hole for intercommunicating in a lower part thereof into a smell removing chamber for removing said gaseous smelling component fed from said outlet; a discharge gaseous chamber having an outlet for discharging gas fed from said smell removing chamber through said through hole for intercommunicating after removal of said gaseous smelling component; and a heat intake port from a burner wherein said inlet is adjacent thereto for burning said gaseous smelling component and heating said flash chamber.

2. The apparatus of claim 1, wherein said drawing water barrel is rotatably installed at one end along said inner barrel wall and is comprised of a V-shaped groove having a downward slant in a direction of one end faced with said space.

3. An apparatus for thermal treatment of human waste according to claim 1, comprising a shaft rotatably installed in a position along a longitudinal axis in said inner barrel; an agitating plate for agitating said human waste and a drawing water barrel for drawing said human waste, wherein said shaft is installed and provided in said reservoir chamber; a scraper mounted on said axis and provided in said flash chamber for rotation along an inner wall of said inner barrel by rotating said shaft and scraping said residue of human waste.

4. An apparatus for thermal treatment of human waste according to claim 1, wherein said outer barrel is entirely covered by an air fed from an air intaking port and a jacket is built up on a periphery thereof for supplying said air into said burner as air for combusting.

* * * * *

UNITED STATES PATENT AND TRADEMARK OFFICE

CERTIFICATE OF CORRECTION

PATENT NO. : 5,009,172

DATED : April 23, 1991

INVENTOR(S) : KOGA et al.

It is certified that error appears in the above-identified patent and that said Letters Patent is hereby corrected as shown below:

Title page, item

[73] Assignee: Delete "Kabushiki Kaisha Toyoseiakusho", insert therefor -- Kabushiki Kaisha Toyoseisakusho --

Signed and Sealed this

Thirtieth Day of March, 1993

*Attest:*

STEPHEN G. KUNIN

*Attesting Officer*

*Acting Commissioner of Patents and Trademarks*